US009177753B2

(12) United States Patent
Yamazaki et al.

(10) Patent No.: US 9,177,753 B2
(45) Date of Patent: Nov. 3, 2015

(54) RADIATION GENERATING TUBE AND RADIATION GENERATING APPARATUS USING THE SAME

(71) Applicant: CANON KABUSHIKI KAISHA, Tokyo (JP)

(72) Inventors: Koji Yamazaki, Ayase (JP); Kazuyuki Ueda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 13/669,240

(22) Filed: Nov. 5, 2012

(65) Prior Publication Data

US 2013/0121473 A1 May 16, 2013

(30) Foreign Application Priority Data

Nov. 10, 2011 (JP) ..... 2011-246106

(51) Int. Cl.
*H01J 35/06* (2006.01)
*H01J 35/14* (2006.01)
*H01J 35/16* (2006.01)

(52) U.S. Cl.
CPC ..... *H01J 35/16* (2013.01); *H01J 2235/06* (2013.01); *H01J 2235/186* (2013.01)

(58) Field of Classification Search
CPC ..... H01J 35/00; H01J 35/02; H01J 35/025; H01J 35/04; H01J 35/06; H01J 35/065; H01J 35/08; H01J 35/14; H01J 35/16
USPC ..... 378/136–141
See application file for complete search history.

(56) References Cited

U.S. PATENT DOCUMENTS 3,034,009 A * 5/1962 Mahn et al. ..... 313/456
3,192,425 A * 6/1965 Foster ..... 378/138

(Continued)

FOREIGN PATENT DOCUMENTS

JP 9-180660 A 7/1997
JP 2010-086861 A 4/2010

OTHER PUBLICATIONS

Tibtech Innovations, Properties Table of Stainless Steel, Metals and Other Conductive Materials, http://www.tibtech.com/conductivity.php, 2011.*

(Continued)

*Primary Examiner* — Robert Kim
*Assistant Examiner* — David E Smith
(74) *Attorney, Agent, or Firm* — Canon USA Inc., IP Division

(57) ABSTRACT

A radiation generating tube includes a cathode connected to an electron emitting member; an anode including a target; and an insulating tube disposed between the cathode and the anode to surround the electron emitting member. The insulating tube includes an electrical potential defining member at an intermediate portion of the insulating tube in a longitudinal axis direction of the insulating tube. The electrical potential defining member is electrically connected to an electrical potential defining unit. The potential of the electrical potential defining member is controlled to be higher than that of the cathode and lower than that of the anode. A boundary of the electrical potential defining member and the insulating tube does not face a portion of the anode exposed to the inside of the radiation generating tube.

20 Claims, 5 Drawing Sheets

(56) References Cited

U.S. PATENT DOCUMENTS

| | | | | |
|---|---|---|---|---|
| 3,344,298 | A * | 9/1967 | Martin | 378/122 |
| 4,995,069 | A * | 2/1991 | Tanaka | 378/200 |
| 2004/0114722 | A1* | 6/2004 | Shimono | 378/138 |
| 2005/0141670 | A1* | 6/2005 | Ichikawa et al. | 378/138 |
| 2009/0010393 | A1* | 1/2009 | Klinkowstein et al. | 378/140 |
| 2011/0114830 | A1* | 5/2011 | Reijonen et al. | 250/251 |

OTHER PUBLICATIONS

"Development of Portable X-ray Sources Using Carbon Nanostructures—A step toward X-ray nondestructive inspection and Röntgen examination using dry batteries as a power source—( Translation of AIST press release of Mar. 19, 2009 ) http://www.aist.go.jp/aist_e/latest_research/2009/20090424/20090424.html".

* cited by examiner

RADIATION GENERATING TUBE AND RADIATION GENERATING APPARATUS USING THE SAME

BACKGROUND OF THE INVENTION

1. Field of the Invention

The present invention relates to a radiation generating tube which includes a transmission target. The present invention relates also to radiation generating apparatus in which the radiation generating tube is used.

2. Description of the Related Art

A transmission radiation generating tube is a vacuum tube including a cathode, an anode and an insulating tube. Electrons emitted from an electron source of the cathode are accelerated by high voltage applied between the cathode and the anode. The electrons collide with a transmission target on the anode and cause a ray to generate. The emitted ray is extracted outside through the transmission target. Thus, the transmission target also functions as a ray extraction window. Such a transmission radiation generating tube is used in radiation generating apparatus for medical and industrial use.

Such a transmission radiation generating tube and a reflective radiation generating tube have had a problem about how to improve their voltage withstanding capability. Japanese Patent Laid-Open No. 9-180660 describes a technique to improve voltage withstanding capability. In the described transmission radiation generating tube, a cathode-side end of an electron-focusing electrode is disposed between an insulating tube and a cathode and is fixed thereto. A gap (also known as "creepage distance") is formed between the insulating tube and the focusing electrode. Creepage is the shortest path between two conductive parts (or between a conductive part and the bounding surface of the equipment) measured along the surface of the insulation. A proper and adequate creepage distance protects against tracking, a process that produces a partially conducting path of localized deterioration on the surface of an insulating material as a result of electric discharges on or close to an insulation surface. Since creepage distance of the insulating tube is thus elongated, voltage withstanding capability is improved. Japanese Patent application Laid-Open No. 2010-086861 and non-patent literature (NPL) article "Development of Portable X-ray Sources Using Carbon Nanostructures—A step toward X-ray nondestructive inspection and Rontgen examination using dry batteries as a power source" (Translation of AIST press release of Mar. 19, 2009) {http://www.aist.go.jp/aist_e/latest_research/2009/20090424/20090424.html} each describe a technique to improve voltage withstanding capability by providing an intermediate potential electrode ("intermediate electrode") in a reflective radiation generating tube.

If, however, further improvement in voltage withstanding capability is desired in these techniques described above, the following problems are foreseen to potentially arise. In the technique described in Japanese Patent Laid-Open No. 9-180660, local potential of the insulating tube is determined in accordance with a dielectric constant (or volume resistivity in certain cases) of the insulating tube. There is, therefore, a possibility that electrical discharge occurs between the focusing electrode and an inner wall of the insulating tube in some situations depending on a distance from the focusing electrode to the inner wall of the insulating tube. For this reason, further improvement in the voltage withstanding capability in this technique has not been achieved. In the techniques described in Japanese Patent Laid-Open No. 2010-086861 and "Development of Portable X-ray Sources Using Carbon Nanostructures—A step toward X-ray nondestructive inspection and Rontgen examination using dry batteries as a power source", since the intermediate electrode protrudes further toward an inner space than an inner wall surface of the insulating tube, electrons are emitted at an end portion of the intermediate electrode or from between a boundary of the intermediate electrode and the inner wall of the radiation generating tube. There is, therefore, a possibility that electrical discharge occurs between the intermediate electrode and the anode. For this reason, further improvement in the voltage withstanding capability in this technique has not been achieved.

SUMMARY OF THE INVENTION

The present invention provides exemplary embodiments of a radiation generating tube of high voltage withstanding capability. In this radiation generating tube, an inner wall surface potential control structure of an insulating tube that is configured to reduce unnecessary electron emission reduces undesired electrical discharge between an intermediate electrode and an anode inside the radiation generating tube and, therefore, voltage withstanding capability is improved. The present invention also provides radiation generating apparatus.

In accordance with at least one exemplary embodiment of the present invention, a radiation generating tube, includes: a cathode connected to which an electron emitting member including an electron emitting portion; an anode which includes a target that generates a ray when irradiated with electrons emitted from the electron emitting portion; and an insulating tube disposed between the cathode and the anode to surround the electron emitting member, wherein: the insulating tube includes an electrical potential defining member at an intermediate portion of the insulating tube between the cathode and the anode in a longitudinal axis direction of the insulating tube, the electrical potential defining member being electrically connected to an electrical potential defining unit, and the potential of the electrical potential defining member being controlled to be higher than the potential of the cathode and lower than the potential of the anode; a boundary of the electrical potential defining member and the insulating tube does not face a portion of the anode exposed to the inside of the radiation generating tube; and the electrical potential defining member does not include a corner which faces the portion of the anode exposed to the inside of the radiation generating tube.

According to the present invention: the electrical potential defining member is disposed at an intermediate portion of the insulating tube of the radiation generating tube in the longitudinal axis direction of the insulating tube; the boundary of the electrical potential defining member and the insulating tube does not face a portion of the anode exposed to the inside of the radiation generating tube; and the electrical potential defining member does not include a corner which faces the portion of the anode exposed to the inside of the radiation generating tube. With this configuration, field intensity at portions at which electric fields converge, such as a protruding portion, like a corner of the electrical potential defining member, and a boundary of the electrical potential defining member and the insulating tube may be reduced. Further, even if undesirable electrons are emitted, it is not easy for those electrons to reach the anode, whereby electrical discharge may be reduced. Therefore, a radiation generating tube of high voltage withstanding capability and radiation generating apparatus capable of performing high energy output are provided.

Further features according to the present invention will become apparent from the following description of exemplary embodiments with reference to the attached drawings.

DESCRIPTION OF THE EMBODIMENTS

Figure 1A:
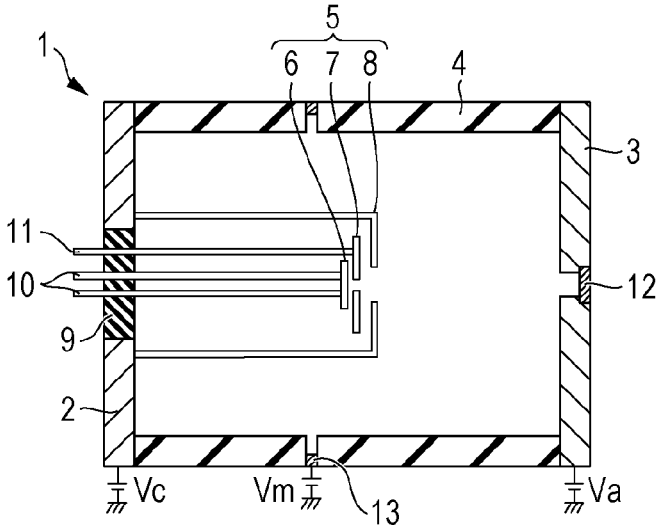
FIGS. 1A to 1C are schematic sectional views illustrating a radiation generating tube, in accordance with an exemplary embodiment of the present invention.

Hereinafter, with reference to the drawings, preferred embodiments of a radiation generating tube and radiation generating apparatus of the present invention will be described in detail. Materials, dimensions, shapes, relative positions, etc., of the constituents of the embodiments described below are not intended to limit the invention unless otherwise stated.

A configuration of the radiation generating tube of the present invention will be described with reference to FIGS. 1A to 1C, 2A and 2B. FIGS. 1A to 1C, 2A and 2B are diagrams illustrating, in schematic cross-sectional views, embodiments of the radiation generating tube of the present invention.

The radiation generating tube 1 is a vacuum tube which includes a cathode 2, an anode 3 and an insulating tube 4.

An electron emitting member 5 including an electron emitting portion is connected to the cathode 2. The electron emitting member 5 protrudes toward the anode 3. The electron emitting member 5 mainly includes an electron source 6, a grid electrode 7 and a focusing electrode 8.

The electron source 6 emits electrons. An electron emitting element of the electron source 6 may be either a cold cathode or a hot cathode. In the radiation generating tube of the present embodiment, an impregnated cathode (hot cathode), which is capable of reliably extracting high current, may be suitably selected as the electron source. The impregnated cathode emits electrons when heated with a thermal flux form a heater. The heater is provided near the electron emitting portion of the impregnated cathode and generates the thermal flux with electrical current applied thereof.

Predetermined voltage is applied to the grid electrode 7 for the extraction, in the vacuum, of the electrons emitted from the electron source 6. The grid electrode 7 is disposed at a predetermined distance from the electron source 6. The shape, the diameter, the aperture ratio, etc., of the grid electrode 7 are determined in consideration of extraction efficiency of the electrons and exhaust air conductance in the vicinity of the electron source 6. Desirably, for example, the grid electrode 7 is a tungsten mesh of about 50 micrometers in wire diameter.

The focusing electrode 8 controls expansion of an electron beam (i.e., a beam diameter) which has been extracted by the grid electrode 7. Typically, the beam diameter is adjusted by the voltage of about hundreds of volts to several kV applied to the focusing electrode 8. The electron beam may be converged by only the lens effect caused by an electric field as long as the structure in the vicinity of the electron source 6 is suitably established and the voltage is suitably applied. In such a case, it is not necessary to provide the focusing electrode 8.

The cathode 2 includes an insulating member 9. A terminal for driving the electron source 10 and a terminal for grid electrode 11 are fixed to the insulating member 9 and thus are electrically insulated from the cathode 2. The terminal for driving the electron source 10 and the terminal for grid electrode 11 extend toward the cathode from the electron source 6 and the grid electrode 7, respectively, in the radiation generating tube 1, and are extracted out of the radiation generating tube 1. The focusing electrode 8 is directly fixed to the cathode 2 and is at the same potential with that of the cathode 2. In an alternative configuration, the focusing electrode 8 may be insulated from the cathode 2 and may be at different potential from that of the cathode 2. In this case, the potential of the focusing electrode 8 may be determined so that the electrons emitted from the electron source 6 efficiently collide with a target 12.

The anode 3 includes the target 12 which emits rays when irradiated with an electron beam of predetermined energy. Voltage of several tens of kV to about 100 kV is applied to the anode 3. The electron beam generated by the electron source 6, emitted from the electron emitting portion and extracted by the grid electrode 7 is guided by the focusing electrode 8 toward the target 12 on the anode 3. The electron beam is then accelerated by the voltage applied to the anode 3 and made to collide with the target 12, whereby rays are generated. The generated rays are radiated in all directions: among them, the rays having passed through the target 12 are extracted out of the radiation generating tube 1.

The target 12 may include a metal film and a substrate which supports the metal film. Alternatively, the target 12 may only include a metal film. The metal film generates a ray when an electron beam collides therewith. The substrate transmits rays. If the target 12 includes a metal film and a substrate, the metal film is disposed on a surface of the substrate which is irradiated with the electron beam (i.e., a surface of the substrate on the side of the electron emitting member). Typically, the metal film may be made of elements of atomic number 26 or higher. Namely, a thin layer made of, for example, tungsten, molybdenum, chromium, copper, cobalt, iron, rhodium and rhenium or alloys thereof may be used suitably. The metal film is formed by physical processes, such as sputtering, to obtain a fine film structure. The optimum value of the thickness of the metal film is not uniformly defined because the electron beam permeation depth, i.e., an area in which the ray is generated, differs depending on the acceleration voltage. Typically, the thickness of the metal film is several micrometers to about 10 micrometers when acceleration voltage of about 100 kV is applied. The substrate needs to be high in radiation transmittance, high thermal conductivity and needs to withstand vacuum-sealing. For example, diamond, silicon nitride, silicon carbide, aluminum carbide, aluminum nitride, graphite and beryllium may be suitably used. Diamond, aluminum nitride and silicon nitride are more suitable because these materials are high in radiation transmittance and higher in thermal conductivity than tungsten. Among these, diamond is more suitable for its high thermal conductivity, radiation transmittance, and capability of keeping the vacuum state. The thickness of the substrate may be determined so that the function described above is carried out. Desirably, the thickness of the substrate is 0.1 mm or more to 2 mm or less depending on the material. The target 12 is fixed to the anode 3 desirably by, in addition to a thermal process, brazing or welding in consideration of keeping a vacuum state.

The insulating tube 4 is formed by an insulating member, such as glass and ceramic. The insulating tube 4 is disposed between the cathode 2 and the anode 3 to surround the electron emitting member 5. The insulating tube 4 is fixed, at both ends thereof, to the cathode 2 and the anode 3 by brazing or welding. The shape of the insulating tube 4 is not particularly limited as long as it is suitable to form a vacuum tube. However, a cylindrical shape is desirable from the viewpoint of reduction in size or ease in manufacture. If air is exhausted from the radiation generating tube 1 with the application of heat in order to increase a degree of vacuum in the radiation generating tube 1, the cathode 2, the anode 3, the insulating tube 4 and the insulating member 9 are desirably made of materials with low coefficient of thermal expansion. For example, the cathode 2 and the anode 3 are desirably made of Kovar or tungsten, and the insulating tube 4 and the insulating member 9 are desirably made of borosilicate glass or alumina.

In the above-described radiation generating tube 1, the focusing electrode 8 is closest to the insulating tube 4 among other electrodes disposed on the cathode side. In such a case, voltage withstanding capability of the radiation generating tube 1 may be further improved by increasing voltage withstanding capability in the space between the insulating tube 4 and the focusing electrode 8. Voltage withstanding capability in the space may be increased by reducing field intensity between the insulating tube 4 and the focusing electrode 8. The present invention proposes lowering the potential of the insulating tube 4 as a method of reducing field intensity without increasing the size of the radiation generating tube. Hereinafter, a configuration provided with the focusing electrode 8 will be described with reference to FIGS. 1A to 1C. However, the focusing electrode 8 may be replaced by another member, such as the grid electrode 7, which constitutes the electron emitting member 5. The grid electrode 7 is not necessarily provided depending on the configuration of the electron source 6: in such a case, the grid electrode 7 may be replaced by other constituents of the electron emitting member 5.

Lowering of the potential of the insulating tube 4 is achieved by providing the electrical potential defining member 13 at an intermediate portion of the insulating tube 4 in the longitudinal axis direction of the insulating tube. Potential of the electrical potential defining member 13 is controlled to be higher than that of the cathode 2 and to be lower than that of the anode 3 by the electrical potential defining unit. However, since electric fields converge at portions, such as a protruding portion, like a corner of the electrical potential defining member 13, and a boundary of the electrical potential defining member 13 and the insulating tube 4, undesirable electron emitting may be caused depending on the configuration, position and potential of the electrical potential defining member 13. Such electron emitting may induce electrical discharge. Therefore, in order to prevent undesirable electron emitting, it is necessary that the boundary of the electrical potential defining member 13 and the insulating tube 4 not be exposed to the anode 3 and that the electrical potential defining member 13 includes no corner which is exposed to the anode 3. In particular, it is necessary that the boundary of the electrical potential defining member 13 and the insulating tube 4 does not face a portion of the anode 3 which is exposed to the inside of the radiation generating tube 1, and that the electrical potential defining member 13 does not include a corner which faces the portion of the anode 3 exposed to the inside of the radiation generating tube 1. Desirably, the entire electrical potential defining member 13 does not face the portion of the anode 3 exposed to the inside of the radiation generating tube 1. With this configuration, field intensity at portions at which electric fields converge, such as a protruding portion, like a corner of the electrical potential defining member 13, and a boundary of the electrical potential defining member 13 and the insulating tube 4 may be reduced. Further, even if undesirable electrons are emitted, it is not easy for those electrons to reach the anode 3, whereby electrical discharge may be reduced. If the electrical potential defining member 13 is exposed to the anode 3, it is desirable to exclude the protruding portion of the electrical potential defining member 13. In this case, for example, it is only necessary that the portion of the anode 3 exposed to the inside of the radiation generating tube 1 is rounded at the radius R.

Specific structures of the electrical potential defining member 13 in consideration of the above conditions are proposed hereinafter.

Figure 7A:
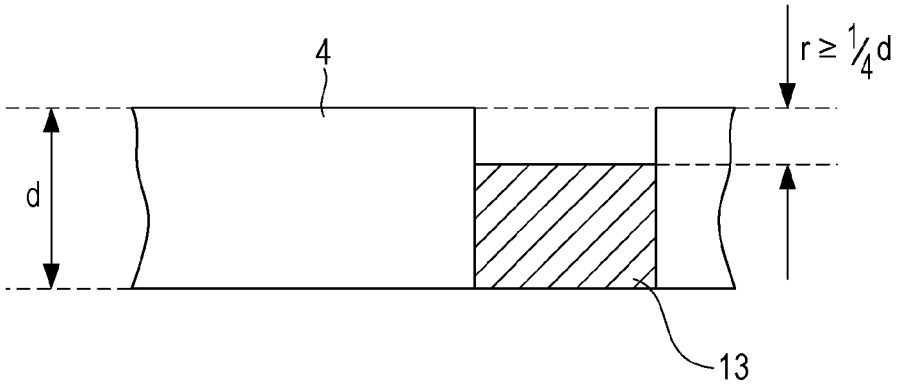
FIGS. 7A, 7B and 7C illustrate specific details of the electrical potential defining member, in accordance with various embodiments.

A first method is, as are illustrated in FIG. 1A, to provide the electrical potential defining member 13 such that a portion of the electrical potential defining member 13 exposed to the inside (i.e., inner space) of the radiation generating tube 1 is recessed toward an outer wall of the insulating tube 4. Specifically, as illustrated in FIG. 7A, it would be advantageous that the electrical potential defining member 13 is recessed at least a distance $r \geq \frac{1}{4}d$ from an inner surface of the insulating tube 4; where d is the thickness of the insulating tube 4. Here, it should be noted that while it is important to minimize undesirable electron emissions by providing the electrical potential defining member 13 recessed at least a distance $r \geq \frac{1}{4}d$ from an inner surface of the insulating tube 4, it is also important to maintain the strength of the insulating tube 4. Accordingly, it may be undesirable to provide the electrical potential defining member 13 recessed a distance greater than $r = \frac{3}{4}d$ from an inner surface of the insulating tube 4. In this manner, the anode 3 does not face the boundary of the electrical potential defining member 13 and the insulating tube 4, or a corner of the electrical potential defining member 13. Indeed, the anode 3 does not directly face the entire electrical potential defining member 13. Further, in this manner, the potential of the insulating tube 4 on the inner side may be controlled directly, whereby potential control for the reduction in electrical discharge may be achieved easily. The recessed electrical potential defining member 13 and the insulating tube 4 may be fixed to each other by welding or brazing.

Figure 1B:
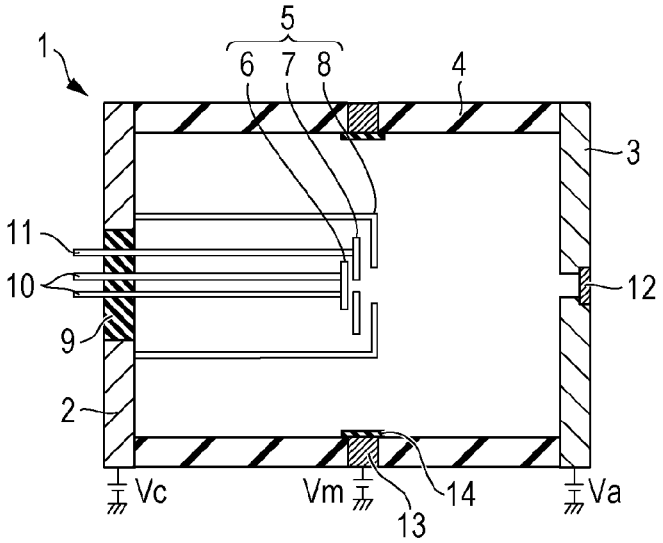

The second method is, as illustrated in FIG. 1B, to cover an end of the electrical potential defining member 13 on the inner side of the radiation generating tube 1 with an insulating member 14. The field intensity may be reduced and, besides that, electron emission is not easily caused since the electrical potential defining member 13 is not exposed to the inside of the radiation generating tube 1. As compared to the first method above, potential of the inner wall of the insulating tube 4 is not directly controlled in this method: however, no problem may arise if the material and thickness of the insulating member 14 are suitably selected. The insulating member 14 may be manufactured by applying an insulation paste on the electrical potential defining member 13 which has been fixed to the insulating tube 4 by welding or brazing, and then baking the insulation paste. Alternatively, the insulating member 14 may be formed into a certain shape in advance and then attached to the electrical potential defining member 13. In FIG. 1B, although the insulating member 14 is formed only in a minimum portion which covers the end of the electrical potential defining member 13 on the inner side of the radiation generating tube 1 and a boundary of the electrical potential defining member 13 and the insulating tube 4, the insulating member 14 may be formed to cover the entire inner wall surface of the insulating tube 4.

Figure 1C:
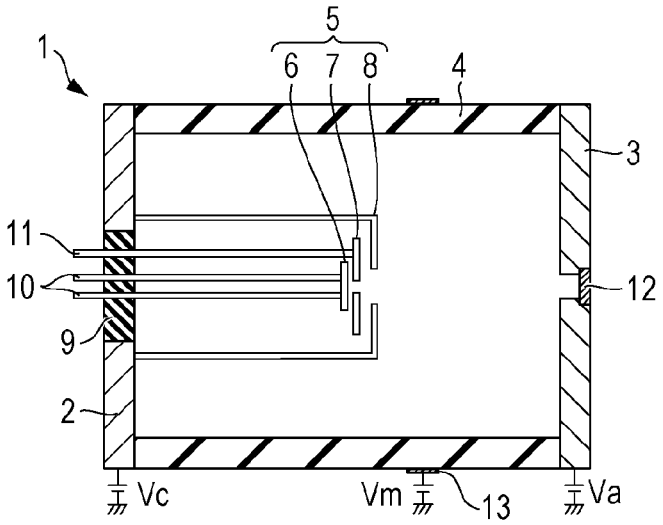

A third method is, as illustrated in FIG. 1C, to form the electrical potential defining member 13 on an outer wall surface of the insulating tube 4. As compared to those of the first and second methods above, this configuration is highly capable of reducing electron emission inside the radiation generating tube (i.e., electron emission may be substantially prevented) because the electrical potential defining member 13 is provided on the outer surface of the insulating tube 4. Regarding static potential control, potential of the inner wall of the insulating tube 4 is determined dominantly by the insulating tube 4 if a material of the insulating tube 4 having the dielectric constant higher than that of vacuum is used. Therefore, even if the electrical potential defining member 13 is provided on the outer wall surface of the insulating tube 4, the potential of the inner wall surface may be controlled. For example, the specific inductive capacity of alumina is about 10 and the specific inductive capacity of borosilicate glass is about 5. The electrical potential defining member 13 may be fixed to the insulating tube 4 by means of, for example, welding, or may be just in contact with the insulating tube 4 instead of being integrated therewith.

Figure 2A:
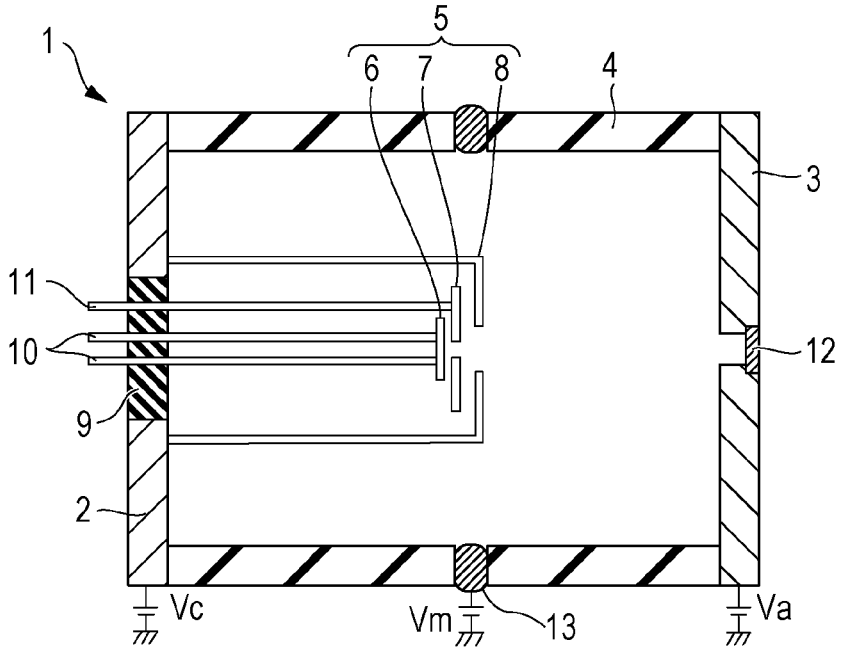
FIGS. 2A and 2B are schematic sectional views illustrating another radiation generating tube, in accordance with a further exemplary embodiment of the present invention.
Figure 7B:
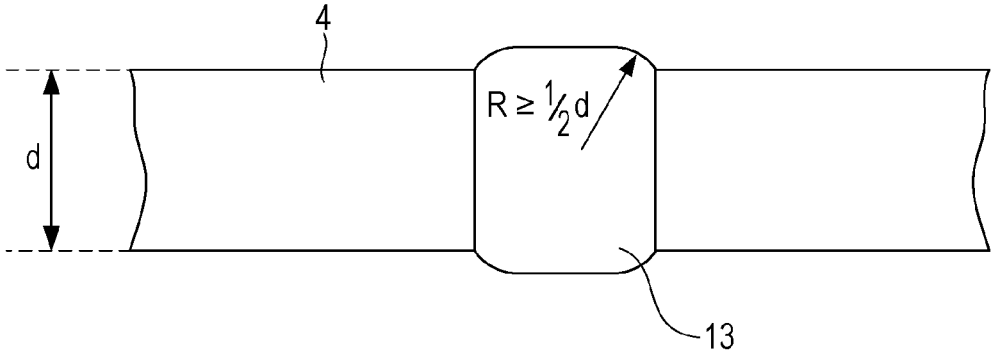
Figure 7C:
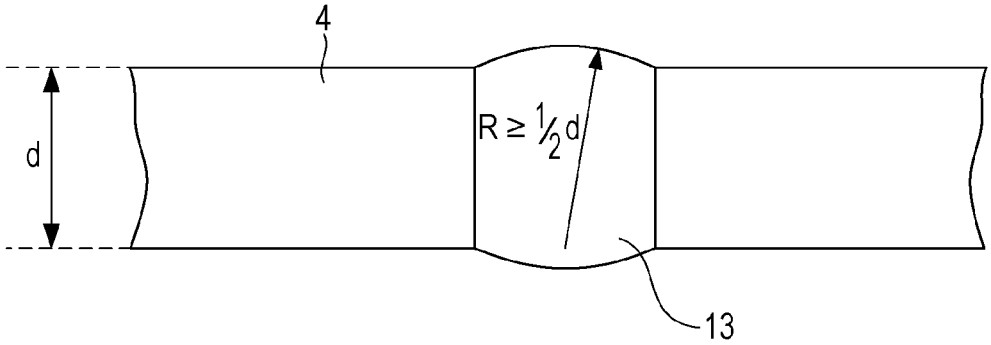

FIG. 2A illustrates a fourth method in which a portion of the electrical potential defining member 13 protruding from the inner wall surface of the insulating tube 4 toward the inside of the radiation generating tube 1 is rounded at a radius R. In FIG. 2A, the boundary of the electrical potential defining member 13 and the insulating tube 4 does not face the portion of the anode 3 exposed to the inside of the radiation generating tube 1. Further, a portion of the electrical potential defining member 13 which faces the portion of the anode 3 exposed to the inside of the radiation generating tube 1 is rounded at the radius R. Since the electrical potential defining member 13 is rounded, local increase in field intensity may be reduced and therefore electron emission can be substantially prevented. As illustrated in FIGS. 7B and 7C, a portion of the electrical potential defining member 13 which faces the anode 3 is rounded at the radius R. Desirably, the radius $R \geq 0.5$ d, where d is the thickness of the insulating tube 4. More specifically, at least a portion of the electrical potential defining member 13 protruding from the inner surface of the insulating tube 4 toward the inside of the radiation generating tube 1 has a continuous and smooth topological profile having radius $R \geq \frac{1}{2}d$ as shown in FIG. 7B. That is, the electrical potential member does not include a sharp corner, but includes at least a portion that is curved with a continuous and smooth topological profile, which faces the anode 3. In an alternate embodiment, the entire protruding portion of the electrical potential defining member 13 may be defined as a continuous and smooth topological profile having radius $R \geq \frac{1}{2}d$ as shown in FIG. 7B.

Figure 2B:
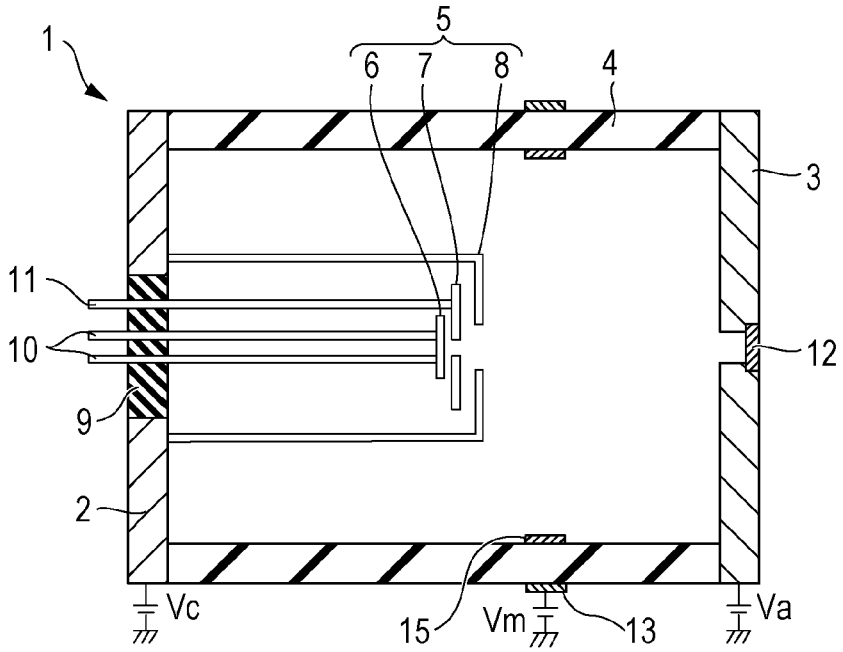

A fifth method is a modification of the third method. As illustrated in FIG. 2B, the electrical potential defining member 13 is provided on the outer wall surface of the insulating tube 4, and another electrical potential defining member 15 is provided on the inner wall surface of the insulating tube 4. The electrical potential defining member 15 is disposed to face the electrical potential defining member 13 via the insulating tube 4. Potential of the electrical potential defining member 15 is indirectly controlled by capacitive coupling with the electrical potential defining member 13. Capacitive coupling is advantageous in that, since there is no direct electron source, DC electron emission is less easily caused and, therefore, uniformity and stability in potential inside the radiation generating tube 1 improve. Application of the first, second and fourth methods in combination to the electrical potential defining member 15 is more desirable for the reduction in electron emitting.

Any of the first to fifth methods described above may be used suitably in the present invention.

The electrical potential defining member 13 may be discretely disposed on an imaginary plane which has a normal axis parallel to the longitudinal axis direction of the insulating tube 4. Although the desirable shape of the insulating tube 4 is cylindrical in the foregoing description, the shape of the insulating tube 4 is not limited to the same. If the focusing electrode 8 and an inner wall of the insulating tube 4 are not the same in shape, the electrical potential defining member 13 may be disposed at least at locations at which the distance between the focusing electrode 8 and the insulating tube 4 is short. For example, if the cross section of the focusing electrode 8 is round and the cross section of the insulating tube 4 is triangular, the electrical potential defining member 13 may be disposed at three locations. If the cross section of the focusing electrode 8 is round and the cross section of the insulating tube 4 is rectangular, the electrical potential defining member 13 may be disposed at four locations. If the electrical potential defining member 13 is disposed in this manner, each piece of the electrical potential defining member 13 is small in size and thus the amount of discharge current even if electrical discharge occurs is small. Therefore, damage to a power circuit or other constituents may be reduced.

The electrical potential defining member 13 may be disposed as a ring on an imaginary plane which has a normal axis parallel to the longitudinal axis direction of the insulating tube 4. A configuration in which, for example, the focusing electrode 8 and the insulating tube 4 are disposed at equal distance from each other in the entire circumference is desirable from the viewpoint of uniformity in potential.

Figure 3:
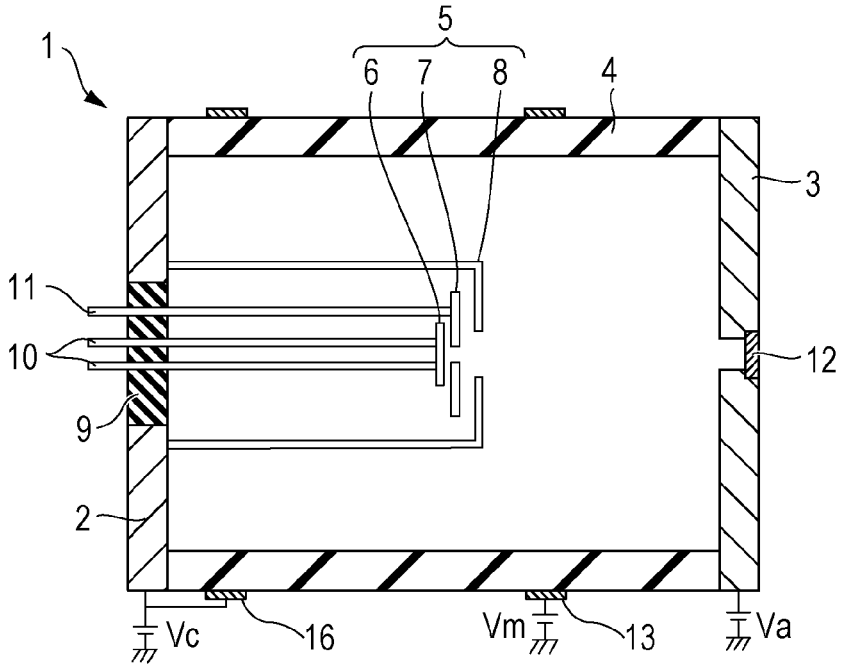
FIG. 3 is a schematic sectional view illustrating a radiation generating tube in which two electrical potential defining members are provided, in accordance with an exemplary embodiment of the present invention.
Figure 4:
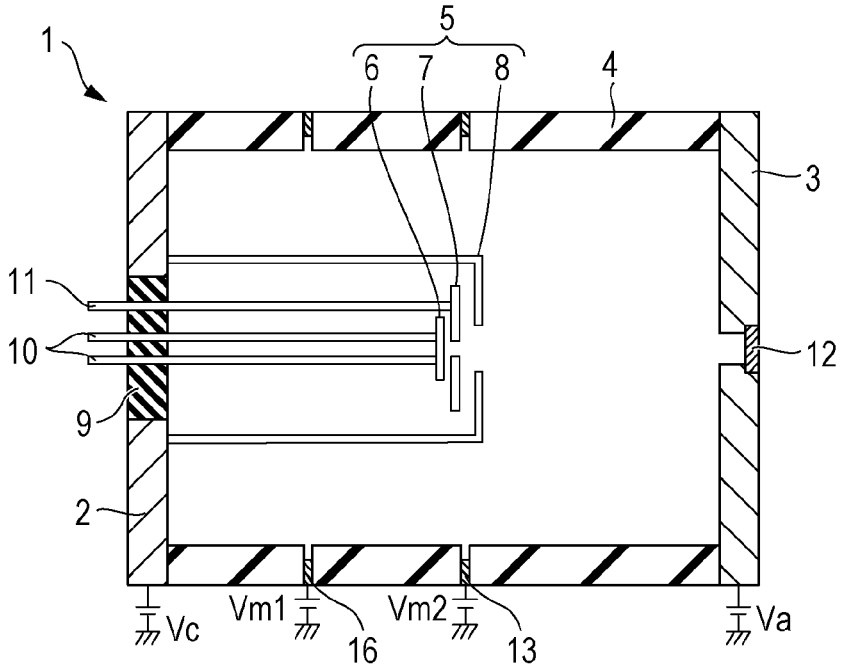
FIG. 4 is a schematic sectional view illustrating another radiation generating tube in which two electrical potential defining members are provided, in accordance with a further exemplary embodiment of the present invention.

As illustrated in FIG. 3 or FIG. 4, plural electrical potential defining members 13 and 16 may be provided along the longitudinal axis direction of the insulating tube 4. Plural electrical potential defining members may inevitably make desired potential distribution. Besides reduction in field intensity of the focusing electrode 8 and the insulating tube 4, other functions may be performed. For example, as illustrated in FIG. 3, if an electrical potential defining member 16, which is another electrical potential defining member, is disposed near the cathode 2 and the potential thereof is controlled to the cathode potential, field intensity at the boundary of the cathode 2 and the insulating tube 4 may be reduced and thus electron emission from this place may be reduced. If the electrical potential defining member is provided only on the outer wall surface, the effect of this configuration is large if the distance of an anode-side end of the electrical potential defining member 16 from the cathode 2 is longer than the wall thickness of the insulating tube 4. If the electrical potential defining member 13 is not provided but the electrical potential defining member 16 is independently provided, this configuration may reduce the field intensity of the focusing electrode 8 and the insulating tube 4. In addition, in a configuration in which the electrical potential defining member 13 is exposed to the inside of the radiation generating tube as illustrated in FIG. 4, it is possible to trap the electrons in a process in which the electrons hop on the inner wall surface of the insulating tube 4. Therefore, an effective arrangement of the constitutions enables increase in voltage withstanding capability along the surface of the insulating tube 4. For example, it is possible to control potential of each of plural electrical potential defining members to become higher as they approach the anode 3 from the cathode 2.

In consideration of decreasing the field intensity between the electrical potential defining member 13 and the anode 3, the position and potential of the electrical potential defining member 13 is desirably determined in the following manner. The electrical potential defining member 13 is disposed at a position of which distance from the cathode 2 is equal to or shorter than the distance between the cathode 2 and an anode-side end of the electron emitting member. Potential of the electrical potential defining member 13 is set to be equal to or smaller than {(potential of the anode)−(potential of the cathode)}×(distance between the cathode and the anode-side end of the electron emitting member)/(distance between the cathode and the anode). In FIG. 1A, the anode-side end of the electron emitting member is an end of the focusing electrode 8.

Figure 5:
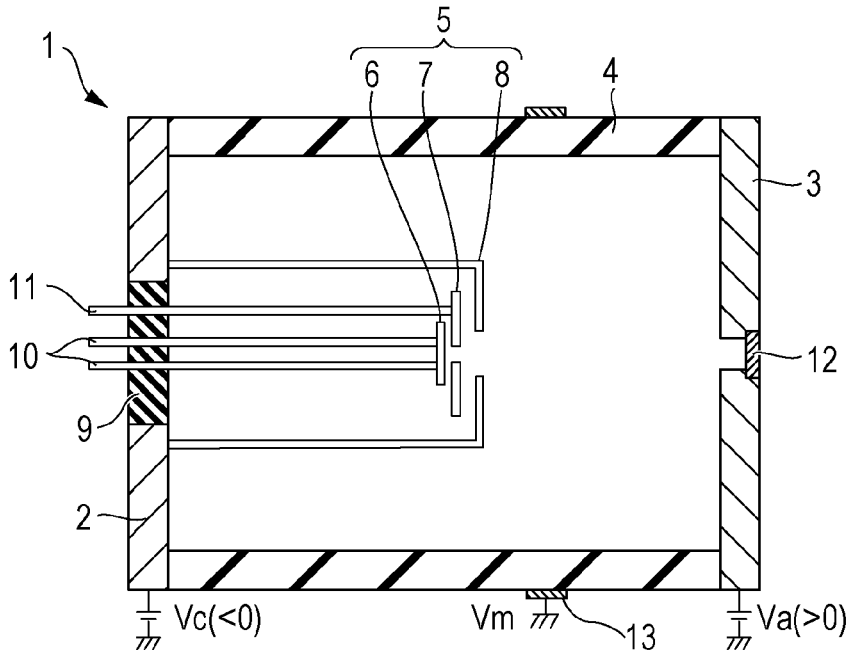
FIG. 5 is a schematic sectional view illustrating a radiation generating tube in which a potential of the electrical potential defining member is the ground potential, in accordance with an exemplary embodiment of the present invention.

If the cathode 2 is in negative polarity and the anode 3 is in positive polarity, it is desirable that potential of the electrical potential defining member 13 is set to the ground potential as illustrated in FIG. 5. If GND is used as the electrical potential defining unit and the potential of the electrical potential defining member 13 is set to the ground potential, the electrical potential defining unit may function also as a fixing member (not illustrated) for fixing the radiation generating tube 1 to radiation generating apparatus.

Desirably, the conductivity of the electrical potential defining member 13 is 10 or more times higher than that of the insulating tube 4 from the viewpoint of uniformity in potential of the electrical potential defining member 13 itself. More desirably, the conductivity of the electrical potential defining member 13 is equal to or greater than 1E−3 S/m.

Radiation generating apparatus 17 may be manufactured using the radiation generating tube 1. The radiation generating apparatus 17 in which the radiation generating tube 1 of the present invention is used is illustrated in a schematic diagram in FIG. 6. The radiation generating apparatus 17 includes a housing 18 in which the radiation generating tube 1 and a power circuit 19 electrically connected to the radiation generating tube 1 are accommodated. The housing 18 includes a ray radiation window 20 disposed at a position in accordance with the position of the target 12 (not illustrated) of the radiation generating tube 1. The housing 18 is filled with an insulating fluid 21, such as insulation oil, and is sealed. The cathode 2, the anode 3, the terminal for driving the electron source 10, the terminal for grid electrode 11 and the electrical potential defining member 13 are connected to the power circuit 19. Potential of these constituents is controlled suitably. The electrical potential defining member 13 is electrically connected to an electrical potential defining unit. The power circuit 19 includes a voltage source (not illustrated) as an electrical potential defining unit of the electrical potential defining member 13. The power circuit 19 may include GND instead of the voltage source as the electrical potential defining unit of the electrical potential defining member 13.

First Example

A first example, which is one of the exemplary configurations described above, will be described with reference to FIG. 1A. FIG. 1A is a schematic cross-sectional view of a radiation generating tube 1 along a central axis of an insulating tube 4. The radiation generating tube 1 includes a cathode 2, an anode 3, the insulating tube 4, an electron emitting member 5, an insulating member 9, a terminal for driving electron source 10, a terminal 11 for grid electrode, a target 12 and an electrical potential defining member 13. The electron emitting member 5 includes an electron source 6, a grid electrode 7 and a focusing electrode 8.

The cathode 2, the anode 3 and the electrical potential defining member 13 are made of Kovar. The insulating tube 4 and the insulating member 9 are made of alumina. These constituents are fixed to each other by welding. The insulating tube 4 is cylindrical in shape. The electron source 6 is a cylindrical-shaped impregnated cathode including an impregnated electron emitting portion (emitter), and is fixed to an upper end of a cylindrical sleeve. A heater is disposed in the sleeve. When the heater is supplied with current from the terminal for driving the electron source 10, the cathode is heated and the electrons are emitted. The terminal for driving the electron source 10 is brazed to the insulating member 9.

The target 12 is brazed to the anode 3 as a 5-μm-thick tungsten film formed on a 0.5-mm-thick silicon carbide substrate.

In the electron emitting member 5, the electron source 6, the grid electrode 7 and the focusing electrode 8 are arranged in this order toward the target 12. The grid electrode 7 is supplied with current from the terminal for grid electrode 11 and extracts the electrons efficiently from the electron source 6. In the similar manner to the terminal for driving electron source 10, the terminal for grid electrode 11 is brazed to the insulating member 9. The focusing electrode 8 is welded to the cathode 2 and its potential is controlled to the same as that of the cathode 2. The focusing electrode 8 narrows the beam diameter of the electron beam extracted by the grid electrode 7 and makes the electron beam efficiently collide with the target 12.

The cathode 2, the anode 3 and the insulating tube 4 have the same outer diameter of ϕ60 mm and the same inner diameter of ϕ50 mm. The focusing electrode 8 is substantially cylindrical in outer shape and is ϕ25 mm in diameter. The cathode 2, the anode 3, the insulating tube 4 and the focusing electrode 8 are arranged coaxially to each other. The insulating tube 4 is divided into two by the electrical potential defining member 13 which is disposed at an intermediate portion in the longitudinal axis direction of the insulating tube 4. The entire length of the two parts of the insulating tube 4 and the electrical potential defining member 13 in the longitudinal axis direction of the insulating tube 4 is 70 mm. The electrical potential defining member 13 is formed as a ring which is ϕ60 mm in outer diameter, ϕ56 mm in inner diameter and 2 mm in thickness. The electrical potential defining member 13 is fixed to the insulating tube 4 at a position 28 mm from the cathode 2 (i.e., 40 mm from the anode 3). A boundary of the electrical potential defining member 13 and the insulating tube 4, a corner of the electrical potential defining member 13, and the entire electrical potential defining member 13 are not exposed to the anode 3.

The radiation generating tube 1 is exhausted through an exhaust pipe (not shown) and is hermetically sealed with the cathode 2 and the anode 3 respectively.

Five radiation generating tubes 1 illustrated in FIG. 1A are manufactured and are subject to high voltage in insulation oil. The cathode 2 is grounded. The anode 3 is connected to a high-voltage power supply. The plate voltage is increased gradually. The electrical potential defining member 13 is controlled to be one-fifth the potential of the potential of the anode 3. First electrical discharge occurs at 75 kV on average. The cumulative number of electrical discharge up to 100 kV is 1.8 on average. In a configuration provided with no electrical potential defining member 13, the first electrical discharge occurs at 60 kV on average and the cumulative number of electrical discharge up to 100 kV is 5 on average. This demonstrates that the radiation generating tube 1 of this example has improved voltage withstanding capability.

Figure 6:
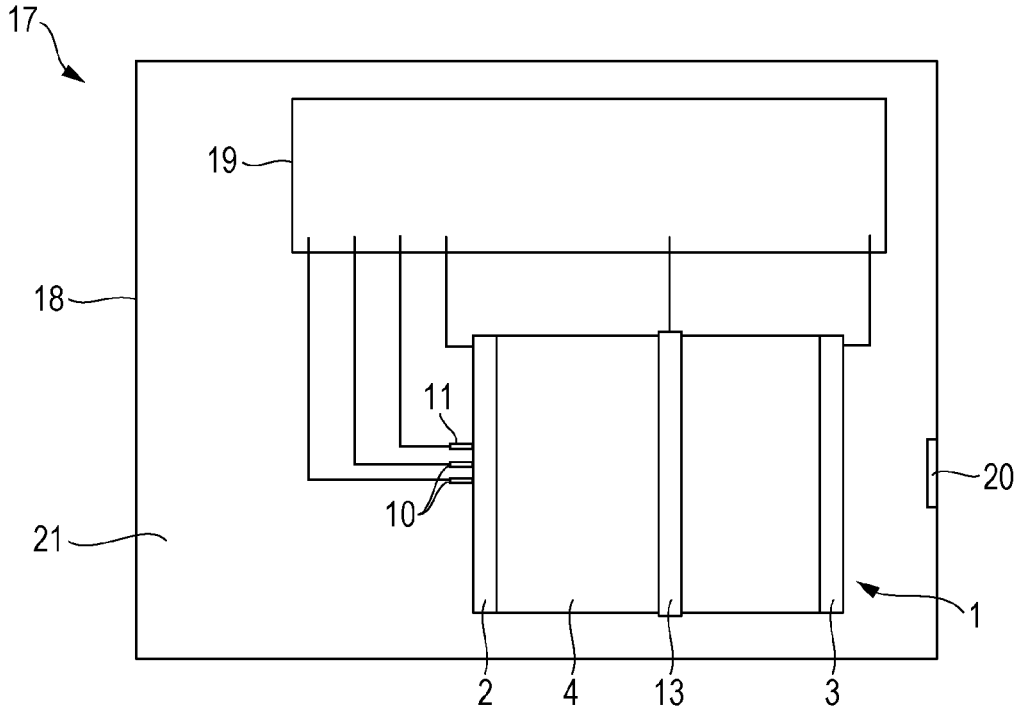
FIG. 6 is a schematic diagram of a radiation generating apparatus in which the radiation generating tube is used, in accordance with an embodiment of the present invention.

Radiation generating apparatus 17 illustrated in FIG. 6 is manufactured using the radiation generating tube 1 of this example. The potential of the cathode 2 is set to −50 kV. The potential of the anode 3 is set to 50 kV. The potential of the electrical potential defining member 13 is set to −30 kV. A ray is successively emitted using the manufactured radiation generating apparatus 17 without any disturbance of electrical discharge.

Second Example

This example differs from the first example in that, as illustrated in FIG. 1B, an end of the electrical potential defining member 13 on the inner side of the radiation generating tube is covered with an insulating member 14. The electrical potential defining member 13 is disposed at a position different from that of the first example. In this example, the electrical potential defining member 13 is formed as a ring which is ϕ60 mm in outer diameter, ϕ56 mm in inner diameter and 5 mm in thickness. The electrical potential defining member 13 is fixed to the insulating tube 4 at a position 35 mm from the cathode 2 (i.e., 30 mm from the anode 3). Glass paste is applied as an insulating member 14 to an end of the fixed electrical potential defining member 13 and is then baked. The thickness of the glass paste is 200 micrometers after the glass paste is baked. The radiation generating tube 1 is exhausted through an exhaust pipe (not shown) and is hermetically sealed with the cathode 2 and the anode 3 respectively.

Five radiation generating tubes 1 illustrated in FIG. 1B are manufactured. The radiation generating tubes 1 are subject to high voltage in insulation oil in the same manner as in the first example. The electrical potential defining member 13 is controlled to be one-fifth the potential of the potential of the anode 3. None of the five radiation generating tubes 1 discharges until voltage is increased to 100 kV. This demonstrates that the radiation generating tube 1 of this example has improved voltage withstanding capability as compared to that of the first example.

Radiation generating apparatus 17 illustrated in FIG. 6 is manufactured using the radiation generating tube 1 of this example. The potential of the cathode 2 is set to −50 kV. The potential of the anode 3 is set to 50 kV. The potential of the electrical potential defining member 13 is set to −30 kV. A ray is successively emitted using the manufactured radiation generating apparatus 17 without any disturbance of electrical discharge.

Third Example

This example differs from the first example in that, as illustrated in FIG. 1C, the electrical potential defining member 13 is disposed on an outer wall surface of the insulating tube 4. The electrical potential defining member 13 is disposed so as to be grounded. In this example, the electrical potential defining member 13 is formed as a ring which is ϕ60 mm in inner diameter, ϕ62 mm in outer diameter and 5 mm in thickness. The electrical potential defining member 13 is fixed to the insulating tube 4 at a position 45 mm from the cathode 2 (i.e., 20 mm from the anode 3). The radiation generating tube 1 is exhausted through an exhaust pipe (not shown) and is hermetically sealed with the cathode 2 and the anode 3 respectively.

Five radiation generating tubes 1 illustrated in FIG. 1C are manufactured. The radiation generating tubes 1 are subject to high voltage in insulation oil in the same manner as in the first example. The electrical potential defining member 13 is controlled to be half the potential of the potential of the anode 3. First electrical discharge occurs at 67 kV on average. The cumulative number of electrical discharge up to 100 kV is 2.9 on average. This demonstrates that the radiation generating tube 1 of this example has improved voltage withstanding capability as compared to that of the first example.

Radiation generating apparatus 17 illustrated in FIG. 6 is manufactured using the radiation generating tube 1 of this example. The potential of the cathode 2 is set to −50 kV. The potential of the anode 3 is set to 50 kV. The potential of the electrical potential defining member 13 is the ground potential. A ray is successively emitted using the manufactured radiation generating apparatus 17 without any disturbance of electrical discharge.

Fourth Example

This example differs from the first example in that, as illustrated in FIG. 2A, the electrical potential defining member 13 is exposed to anode 3 and the exposed portion is rounded. The electrical potential defining member 13 is disposed at a position different from that of the first example. In this example, the electrical potential defining member 13 is formed as a ring which is ϕ60 mm in outer diameter, ϕ44 mm in inner diameter and 5 mm in thickness. The electrical potential defining member 13 is fixed to the insulating tube 4 at a position 35 mm from the cathode 2 (i.e., 30 mm from the anode 3). An end of the electrical potential defining member 13 on the side of the inner space of the radiation generating tube 1 is rounded at the radius R (R=2 mm) along the entire circumference of the radiation generating tube 1. The boundary of the electrical potential defining member 13 and the insulating tube 4 is not exposed to the anode 3. The portion of the electrical potential defining member 13 exposed to the anode 3 is rounded at the radius R. The radiation generating tube 1 is exhausted through an exhaust pipe (not shown) and is hermetically sealed with the cathode 2 and the anode 3 respectively.

Five radiation generating tubes 1 illustrated in FIG. 2A are manufactured. The radiation generating tubes 1 are subject to high voltage in insulation oil in the same manner as in the first example. The electrical potential defining member 13 is controlled to be three-tenth of the potential of the potential of the anode 3. First electrical discharge occurs at 73 kV on average. The cumulative number of electrical discharge up to 100 kV is 1.9 on average. This demonstrates that the radiation generating tube 1 of this example has improved voltage withstanding capability as compared to that of the first example.

Radiation generating apparatus 17 illustrated in FIG. 6 is manufactured using the radiation generating tube 1 of this example. The potential of the cathode 2 is set to −50 kV. The potential of the anode 3 is set to 50 kV. The potential of the electrical potential defining member 13 is set to −20 kV. A ray is successively emitted using the manufactured radiation generating apparatus 17 without any disturbance of electrical discharge.

Fifth Example

In this example, in addition to the feature of the third example, another electrical potential defining member 15 which is capacitively coupled to the electrical potential defining member 13 is provided. The electrical potential defining member 15 is fixed to an inner wall surface of the insulating tube 4 so as to face the electrical potential defining member 13 via the insulating tube 4 as illustrated in FIG. 2B. The radiation generating tube 1 is exhausted through an exhaust pipe (not shown) and is hermetically sealed with the cathode 2 and the anode 3 respectively.

Five radiation generating tubes 1 illustrated in FIG. 2B are manufactured. The radiation generating tubes 1 are subject to high voltage in insulation oil in the same manner as in the first example. The electrical potential defining member 13 is controlled to be half the potential of the potential of the anode 3. First electrical discharge occurs at 67 kV on average. The cumulative number of electrical discharge up to 100 kV is 2.9 on average. This demonstrates that the radiation generating tube 1 of this example has improved voltage withstanding capability as compared to that of the first example.

Radiation generating apparatus 17 illustrated in FIG. 6 is manufactured using the radiation generating tube 1 of this example. The potential of the cathode 2 is set to −50 kV. The potential of the anode 3 is set to 50 kV. The potential of the electrical potential defining member 13 is the ground potential. A ray is successively emitted using the manufactured radiation generating apparatus 17 without any disturbance of electrical discharge.

Sixth Example

In this example, in addition to the feature of the third example, another electrical potential defining member 16 is fixed to an outer wall surface of the insulating tube 4 at a position further toward the cathode than the electrical potential defining member 13 as illustrated in FIG. 3. The electrical potential defining member 16 and the electrical potential defining member 13 are the same in shape. The electrical potential defining member 16 is fixed to the insulating tube 4 at a position 5 mm from the cathode 2 (i.e., 60 mm from the anode 3). The radiation generating tube 1 is exhausted through an exhaust pipe (not shown) and is hermetically sealed with the cathode 2 and the anode 3 respectively.

Five radiation generating tubes 1 illustrated in FIG. 3 are manufactured. The radiation generating tubes 1 are subject to high voltage in insulation oil in the same manner as in the first example. The electrical potential defining member 13 is controlled to be half the potential of the potential of the anode 3. The electrical potential defining member 16 is controlled to follow the potential of the cathode 2. First electrical discharge occurs at 66 kV on average. The cumulative number of electrical discharge up to 100 kV is 3.2 on average. This demonstrates that the radiation generating tube 1 of this example has improved voltage withstanding capability as compared to that of the first example. The amount of current flowing between the anode and the cathode is smaller than that of the third example.

Radiation generating apparatus 17 illustrated in FIG. 6 is manufactured using the radiation generating tube 1 of this example. The potential of the cathode 2 is set to −50 kV. The potential of the anode 3 is set to 50 kV. The potential of the electrical potential defining member 13 is the ground potential. The potential of the electrical potential defining member 16 is set to the cathode potential. A ray is successively emitted using the manufactured radiation generating apparatus 17 without any disturbance of electrical discharge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-246106 filed Nov. 10, 2011, which is hereby incorporated by reference herein in its entirety.

What is claimed is:

1. An x-ray radiation generating tube, comprising:

a cathode connected to an electron emitting member including an electron emitting portion;

an anode which includes a target that generates a ray when irradiated with electrons emitted from the electron emitting portion; and an insulating tube disposed between the cathode and the anode to surround the electron emitting member, wherein:

the insulating tube includes an electrical potential defining disposed at an intermediate portion of the insulating tube between the cathode and the anode in a longitudinal axis direction, the electrical potential defining member being electrically connected to an electrical potential defining unit, and the potential of the electrical potential defining member being controlled to be higher than the potential of the cathode and lower than the potential of the anode;

a boundary of the electrical potential defining member and the insulating tube does not face a portion of the anode exposed to the inside of the radiation generating tube;

the electrical potential defining member does not include a corner which faces the portion of the anode exposed to the inside of the radiation generating tube; and a portion of the electrical potential defining member exposed to the inside of the radiation generating tube is recessed within the insulating tube.

2. The x-ray radiation generating tube according to claim 1, wherein the entire electrical potential defining member is disposed at a position not to face the portion of the anode exposed to the inside of the radiation generating tube.

3. The x-ray radiation generating tube according to claim 1, wherein an end of the electrical potential defining member on the inner side of the radiation generating tube is covered with an insulating member.

4. The x-ray radiation generating tube according to claim 1, wherein the electrical potential defining member is provided on an outer surface of the insulating tube.

5. The x-ray radiation generating tube according to claim 1, wherein a portion of the electrical potential defining member which faces the portion of the anode exposed to the inside of the radiation generating tube is rounded at a radius R.

6. The x-ray radiation generating tube according to claim 5, wherein the radius R is equal to or greater than 0.5 mm.

7. The x-ray radiation generating tube according to claim 4, wherein another electrical potential defining member which is capacitively coupled to the electrical potential defining member is fixed to an inner surface of the insulating tube so as to face the electrical potential defining member via the insulating tube.

8. The x-ray radiation generating tube according to claim 1, wherein the electrical potential defining member is discretely disposed on an imaginary plane which has a normal axis parallel to the longitudinal axis direction of the insulating tube.

9. The x-ray radiation generating tube according to claim 1, wherein the electrical potential defining member is disposed as a ring on an imaginary plane which has a normal axis parallel to the longitudinal axis direction of the insulating tube.

10. The x-ray radiation generating tube according to claim 1, wherein plural electrical potential defining members are provided in the longitudinal axis direction of the insulating tube.

11. The x-ray radiation generating tube according to claim 10, wherein the electrical potential defining member disposed closest to the cathode, among the plural electrical potential defining members, is at the same potential as that of the cathode.

12. The x-ray radiation generating tube according to claim 11, wherein the distance between the anode-side end of the electrical potential defining member disposed closest to the cathode, among the plural electrical potential defining members, and the cathode is longer than the wall thickness of the insulating tube.

13. The x-ray radiation generating tube according to claim 1, wherein:

the electrical potential defining member is disposed at a position of which distance from the cathode is equal to or shorter than the distance between the cathode and an anode-side end of the electron emitting member; and potential of the electrical potential defining member is set to be equal to or smaller than {(potential of the anode)−(potential of the cathode)}×(distance between the cathode and the anode-side end of the electron emitting member)/(distance between the cathode and the anode).

14. The x-ray radiation generating tube according to claim 1, wherein a constituent of the electrical potential defining member has the conductivity that is 10 or more times higher than that of a constituent of the insulating tube.

15. The x-ray radiation generating tube according to claim 14, wherein the conductivity of the electrical potential defining member is equal to or greater than 1E-3 S/m.

16. The x-ray radiation generating tube according to claim 1, wherein potential of the electrical potential defining member is set to a ground potential.

17. X-ray radiation generating apparatus comprising a housing which at least accommodates the radiation generating tube according to claim 1 and a power circuit which is electrically connected to the radiation generating tube.

18. An x-ray radiation generating tube, comprising:

a cathode connected to an electron emitting member including an electron emitting portion;

an anode which includes a target that generates a ray when irradiated with electrons emitted from the electron emitting portion; and an insulating tube disposed between the cathode and the anode to surround the electron emitting member, wherein:

the insulating tube includes an electrical potential defining disposed at an intermediate portion of the insulating tube between the cathode and the anode in a longitudinal axis direction, the electrical potential defining member being electrically connected to an electrical potential defining unit, and the potential of the electrical potential defining member being controlled to be higher than the potential of the cathode and lower than the potential of the anode;

a boundary of the electrical potential defining member and the insulating tube does not face a portion of the anode exposed to the inside of the radiation generating tube;

the electrical potential defining member does not include a corner which faces the portion of the anode exposed to the inside of the radiation generating tube; and an end of the electrical potential defining member on the inner side of the radiation generating tube is covered with an insulating member.

19. The x-ray radiation generating tube according to claim 18, wherein the entire electrical potential defining member is disposed at a position not to face the portion of the anode exposed to the inside of the radiation generating tube.

20. An x-ray radiation generating tube, comprising:

a cathode connected to an electron emitting member including an electron emitting portion;

an anode which includes a target that generates a ray when irradiated with electrons emitted from the electron emitting portion; and an insulating tube disposed between the cathode and the anode to surround the electron emitting member, wherein:

the insulating tube includes an electrical potential defining disposed at an intermediate portion of the insulating tube between the cathode and the anode in a longitudinal axis direction, the electrical potential defining member being electrically connected to an electrical potential defining unit, and the potential of the electrical potential defining member being controlled to be higher than the potential of the cathode and lower than the potential of the anode;

a boundary of the electrical potential defining member and the insulating tube does not face a portion of the anode exposed to the inside of the radiation generating tube;

the electrical potential defining member does not include a corner which faces the portion of the anode exposed to the inside of the radiation generating tube;

the electrical potential defining member is provided on an outer surface of the insulating tube; and another electrical potential defining member which is capacitively coupled to the electrical potential defining member is fixed to an inner surface of the insulating tube so as to face the electrical potential defining member via the insulating tube.

* * * * *